US012544614B2

(12) United States Patent
Gagnon

(10) Patent No.: US 12,544,614 B2
(45) Date of Patent: Feb. 10, 2026

(54) MULTIFUNCTIONAL EXERCISE EQUIPMENT

(71) Applicant: Ab Coaster Holdings, Inc., Lakewood Ranch, FL (US)

(72) Inventor: Sean Gagnon, Lakewood Ranch, FL (US)

(73) Assignee: Ab Coaster Holdings, Inc., Lakewood Ranch, FL (US)

( * ) Notice: Subject to any disclaimer, the term of this patent is extended or adjusted under 35 U.S.C. 154(b) by 92 days.

(21) Appl. No.: 18/611,581

(22) Filed: Mar. 20, 2024

(65) Prior Publication Data

US 2024/0316385 A1 Sep. 26, 2024

Related U.S. Application Data

(60) Provisional application No. 63/453,197, filed on Mar. 20, 2023.

(51) Int. Cl.
*A63B 21/04* (2006.01)
*A63B 21/00* (2006.01)
*A63B 21/055* (2006.01)

(52) U.S. Cl.
CPC ..... *A63B 21/04* (2013.01); *A63B 21/0552* (2013.01); *A63B 21/4034* (2015.10);
(Continued)

(58) Field of Classification Search
CPC ..... A63B 21/00065; A63B 21/00069; A63B 21/04; A63B 21/0552; A63B 21/0628; A63B 21/063; A63B 21/151; A63B 21/154; A63B 21/4033; A63B 21/4034; A63B 21/4035; A63B 21/4049; A63B 23/03541;
(Continued)

(56) References Cited

U.S. PATENT DOCUMENTS 4,125,258 A * 11/1978 McArthur ..... A63B 21/06 482/136
4,185,818 A * 1/1980 Brentham ..... A63B 23/0488 482/112
(Continued)

FOREIGN PATENT DOCUMENTS

DE 20306997 U1 * 7/2003 ..... A63B 23/0488
DE 202015002149 U1 * 3/2015 ..... A63B 21/4031
FR 2636848 A1 * 3/1990 ..... A63B 21/00181

*Primary Examiner* — Gary D Urbiel Goldner
(74) *Attorney, Agent, or Firm* — Kritzer McPhee LLP

(57) ABSTRACT

An exercise device is configured for performing hip abduction and cable exercises. Abductor pads and footpads are coupled to bars which are rotatably coupled to a frame and a platform. During one exercise using the device, a person places their feet on foot plates, places their knees between the abductor pads, and optionally grasps handles for stability. The person then forces their legs outwards, causing the abductor pads to rotate with respect to the frame which remains stationary. As the user relaxes in a controlled manner, the abductor pads rotate back towards their original "resting" positions. In another exercise, a person stands on the platform, grasps one or more handles coupled to cables, and engages their muscles to raise the one or more handles upward or outward. Exercises may be made more challenging by engaging one or more weights from a weight stack.

9 Claims, 2 Drawing Sheets

(52) U.S. Cl.
CPC ..... *A63B 21/4035* (2015.10); *A63B 2225/09* (2013.01); *A63B 2225/102* (2013.01)

(58) Field of Classification Search
CPC ..... A63B 23/03566; A63B 23/0482; A63B 23/0488; A63B 23/12; A63B 2023/0411; A63B 2071/027; A63B 2208/0204; A63B 2225/09; A63B 2225/102
See application file for complete search history.

(56) References Cited

U.S. PATENT DOCUMENTS 4,240,627 A * 12/1980 Brentham ..... A63B 21/4047 482/138
4,478,411 A * 10/1984 Baldwin ..... A63B 21/155 482/136
5,575,744 A * 11/1996 Jones ..... A63B 21/4039 482/136
7,396,319 B1 * 7/2008 Ellis ..... A63B 23/0488 482/136
7,678,022 B1 * 3/2010 Hsieh ..... A63B 21/0624 482/1
8,562,496 B2 * 10/2013 Webber ..... A63B 23/0488 482/133
9,669,251 B2 * 6/2017 Jones-Guinasso ..... A63B 23/0494
12,201,871 B2 * 1/2025 Bolden ..... A63B 21/4049
2009/0082181 A1 * 3/2009 Salvioli ..... A63B 69/0057 482/114
2011/0224058 A1 * 9/2011 Webber ..... A63B 23/0488 482/133
2014/0057761 A1 * 2/2014 Higgins ..... A63B 23/1209 482/94
2018/0290016 A1 * 10/2018 Smith ..... A61H 1/0244
2020/0047025 A1 * 2/2020 Bobin ..... A63B 21/154

* cited by examiner

MULTIFUNCTIONAL EXERCISE EQUIPMENT

TECHNICAL FIELD

This application relates to exercise devices, and more particularly an exercise device for performing hip abduction and cable exercises.

SUMMARY

An exercise device is disclosed for performing hip abduction and cable exercises.

BRIEF DESCRIPTION OF THE DRAWINGS

The detailed description makes reference to the accompanying figures wherein.

The figures are only intended to facilitate the description of the principles disclosed herein. The figures do not illustrate every aspect of the principles disclosed herein and do not limit the scope of the principles disclosed herein. Other objects, features, and characteristics will become more apparent upon consideration of the following detailed description.

DETAILED DESCRIPTION

A detailed illustration is disclosed herein. However, techniques, methods, processes, systems and operating structures in accordance with the principles disclosed herein may be embodied in a wide variety of forms and modes, some of which may be quite different from those disclosed herein. Consequently, the specific structural and functional details disclosed herein are merely representative.

None of the terms used herein, including "platform," "pad," "bar," "plate," "enclosure," "frame," and "handle" are meant to limit the application of the principles disclosed herein. The foregoing terms are used to illustrate the principles disclosed herein and are not intended to be limiting. Other explicit and implicit definitions may also be included below.

Figure 1:
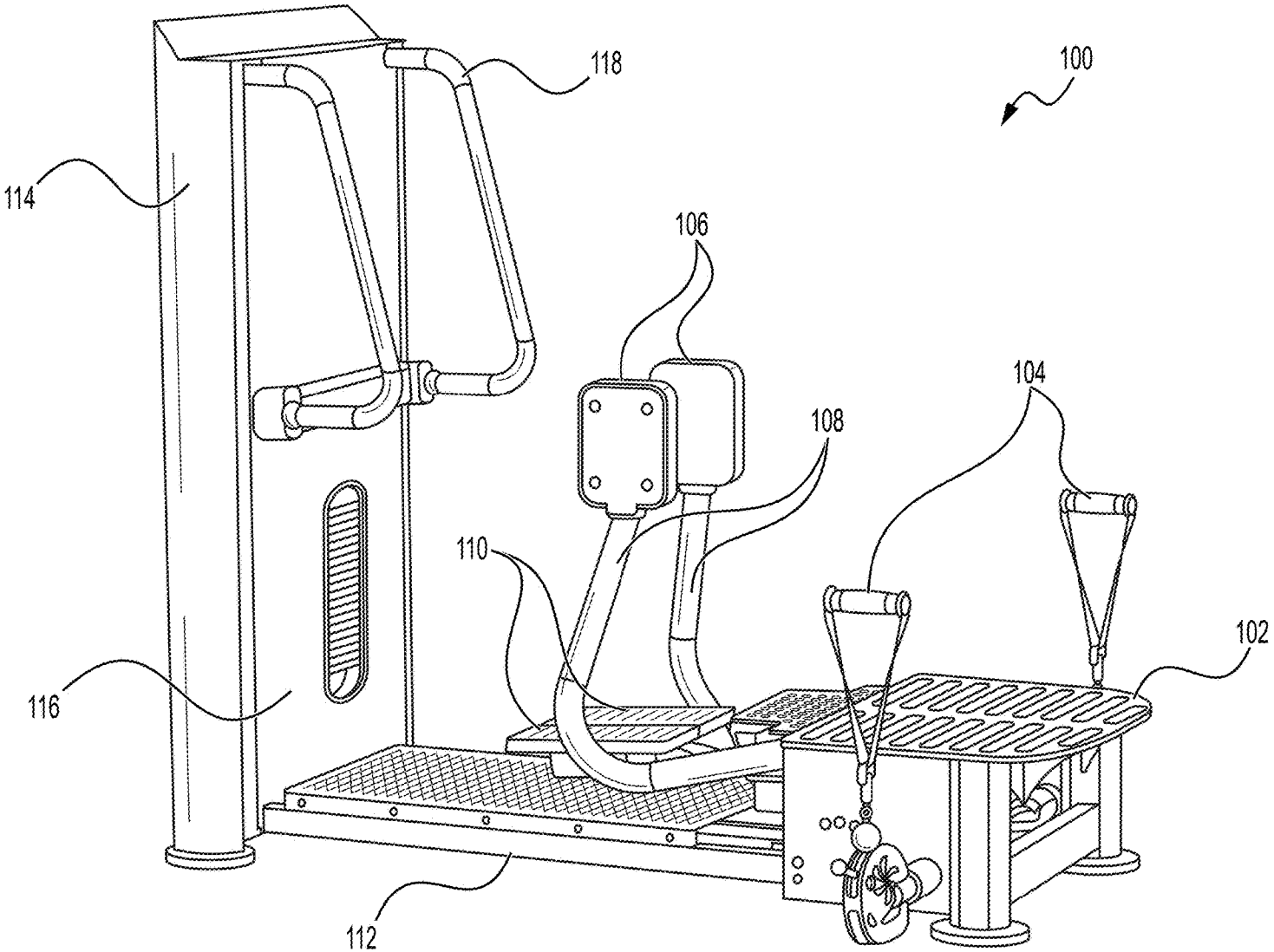
FIG. 1 illustrates an exercise apparatus in accordance with the principles disclosed herein.
Figure 2:
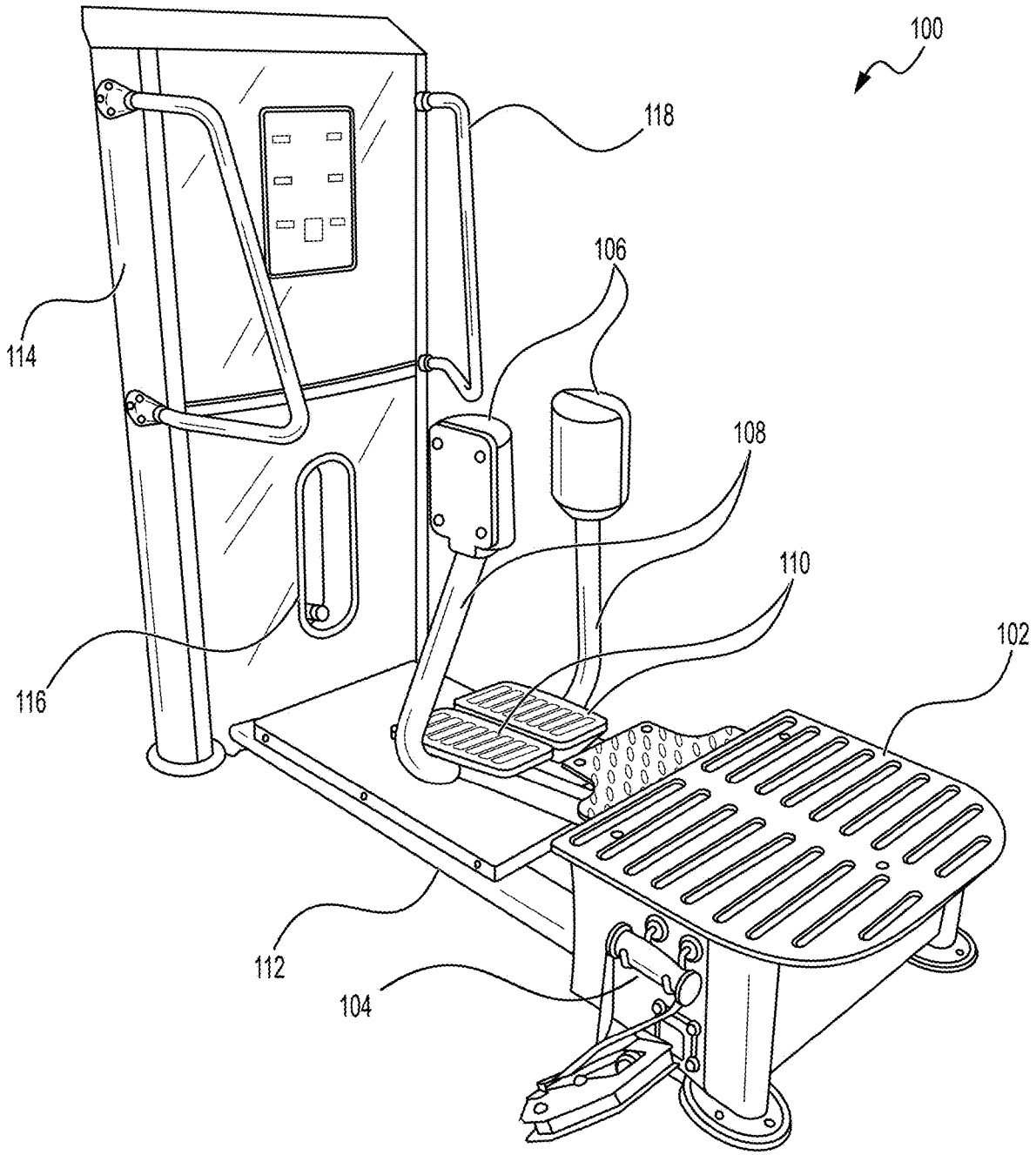
FIG. 2 illustrates a second view of the exercise apparatus shown in FIG. 1.

FIGS. 1 and 2 show an exercise apparatus 100. Platform 102 is coupled to frame 112 and can support a person's weight during exercise. Handles 104 are each coupled via cable to weight stack 116 so that one or more weights can be engaged to provide resistance during exercise. Abductor pads 106 are coupled to bars 108, respectively. Foot plates 110 are also coupled to bars 108, respectively. Bars 108 are each coupled via cable to weight stack 116 so that one or more weights can be engaged to provide resistance during exercise. Handles 118 are coupled to enclosure 114, which is coupled to frame 112.

Exercise apparatus 100 is versatile and offers a person multiple methods of performing exercises. In one example, a person places their feet on foot plates 110, places their knees between abductor pads 106, and optionally grasps handles 118. The person then forces their legs outwards, causing abductor pads 106, bars 108, and foot plates 110 to all rotate with respect to frame 112 which remains stationary. As the user relaxes in a controlled manner, abductor pads 106, bars 108, and foot plates 110 rotate back towards their original "resting" positions.

In another example, a person stands on platform 102, grasps one or both of handles 104, and engages their muscles to raise the one or both of handles 104 upward or outward. Handles 104, and by extension weight stack 116, can be used to provide resistance a person performing squats, lunges, deadlifts, and/or other exercises.

In some embodiments, adduction pads are placed on the outsides of bars 108 and/or the backsides of abductor pads 106. In such embodiments, a selector pin or other suitable mechanism is used to reposition bars 108 outward, so that the bars are separated in a new starting position. The person can then perform a hip adduction exercise by standing on foot plates 110, optionally grasping handles 118, and pressing their legs inward against the adduction pads, causing arms 108 and foot plates 110 to rotate inward with respect to frame 112 which remains stationary. As the user relaxes in a controlled manner, the adductor pads, bars 108, and foot plates 110 rotate back outward towards their original "resting" positions.

Exercises may be made more challenging by engaging one or more weights from weight stack 116. A conventional pin may be used to select an appropriate weight for use during exercise.

In some embodiments, alternative or additional forms of resistance may be used without departing from the principles disclosed herein. For example, weight stack 116 may be replaced or supplemented with a mount for free weights and/or one or more resistance bands.

The detailed description is not intended to be limiting or represent an exhaustive enumeration of the principles disclosed herein. It will be apparent to those of skill in the art that numerous changes may be made in such details without departing from the spirit of the principles disclosed herein.

What is claimed is:

1. An exercise device comprising:

a frame being stationary;

a first leg bar rotationally coupled to the frame and coupled to a source of resistance;

a second leg bar rotationally coupled to the frame and coupled to the source of resistance;

a first foot plate coupled to the first leg bar;

a second foot plate coupled to the second leg bar;

a first leg pad coupled to the first leg bar;

a second leg pad coupled to the second leg bar;

a platform coupled to the frame;

a first handle coupled to a first cable which is coupled to the source of resistance;

a second handle coupled to a second cable which is coupled to the source of resistance;

wherein the first leg bar and the second leg bar are configured so that the first leg pad and the second leg pad rotate apart from each other and back together during exercise; and wherein in a resting position of the exercise device, the first and second handles are adjacent to a ground surface upon which the stationary frame rests.

2. The exercise device of claim 1, wherein the first leg bar and the second leg bar are configured to be in a first position proximate to each other, and wherein the first leg bar and the second leg bar are configured to be forced by a user to rotate away from each other during exercise.

3. The exercise device of claim 2, wherein the first leg bar and the second leg bar are configured to be returned to the first position when the user relaxes.

4. The exercise device of claim 2, wherein the first leg pad and the second leg pad each comprises an adduction pad.

5. The exercise device of claim 1, further comprising:

a first selector pin releasably coupling the first leg bar and the frame, the first selector pin configured so that disengaging the first selector pin enables the first leg bar to rotate substantially freely with respect to the frame without engaging the source of resistance, and so that re-engaging the first selector pin secures the first leg bar to the source of resistance; and a second selector pin releasably coupling the second leg bar and the frame, the second selector pin configured so that disengaging the second selector pin enables the second leg bar to rotate substantially freely with respect to the frame without engaging the source of resistance, and so that re-engaging the second selector pin secures the second leg bar to the source of resistance.

6. The exercise device of claim 5, further comprising:

a first adduction pad coupled to the first leg bar; and a second adduction pad coupled to the second leg bar.

7. The exercise device of claim 1, wherein the source of resistance comprises a stack of one or more selectable weights.

8. The exercise device of claim 1, wherein the source of resistance comprises a mount for one or more free weights.

9. The exercise device of claim 1, wherein the source of resistance comprises one or more resistance bands.

* * * * *